US005444932A

United States Patent [19]

Jeroma

[11] Patent Number: 5,444,932

[45] Date of Patent: Aug. 29, 1995

[54] ELECTRIC SIGN ADVERTISING ELEMENT

[75] Inventor: Rudolf Jeroma, Bremen, Germany

[73] Assignee: Werbelicht KG Rudolf Jeroma, Bremen, Germany

[21] Appl. No.: 322,523

[22] Filed: Oct. 14, 1994

Related U.S. Application Data

[63] Continuation of Ser. No. 845,423, Mar. 6, 1992, abandoned.

[30] Foreign Application Priority Data

Mar. 7, 1991 [DE] Germany ..... 41 07 581.1

[51] Int. Cl.[6] ..... G09F 13/00

[52] U.S. Cl. ..... 40/564; 40/580

[58] Field of Search ..... 40/564, 442, 443, 541, 40/543, 559, 561, 577

[56] References Cited

U.S. PATENT DOCUMENTS

| | | | |
|---|---|---|---|
| 276,558 | 5/1883 | Brown, Jr. | 40/580 |
| 2,058,058 | 10/1936 | Caccia | 40/577 |
| 2,211,571 | 8/1940 | Jonap | 40/577 |
| 5,009,019 | 4/1991 | Erlendsson et al. | 40/543 X |

*Primary Examiner*—Kenneth J. Dorner
*Assistant Examiner*—Cassandra Davis
*Attorney, Agent, or Firm*—Foley & Lardner

[57] ABSTRACT

An illuminatable sign advertising element with a substantially light-impermeable installation carrier, whose interior is provided with at least one light source and is covered with a generally opaque front panel, whose outer side is provided with at least one light transmissive advertisement, which exhibits a different coloration than the region of the front panel adjacent to it, wherein the inside of the front panel is light transmissive in the region of the advertisement and is light impermeable in the adjacent regions, whereby the light transmission intensity of the light transmissive region of the front panel inside varies.

11 Claims, 3 Drawing Sheets

ELECTRIC SIGN ADVERTISING ELEMENT

This application is a continuation of U.S. application Ser. No. 845,423 filed Mar. 6, 1992 now abandoned.

The invention relates to an illuminatable sign advertising element with a substantially light-impermeable, box-shaped installation carrier, whose interior is provided with at least one light source and is covered with a generally translucent (i.e., light transmissive but not transparent), generally white front panel, whose outside, is provided with at least one (printed on, painted on, cemented on or otherwise designed) light transmissive advertisement, which exhibits a different coloration than the region of the front panel adjacent to it.

If the discussion above or in the following is about an "advertisement", then understood shall be thereby within the scope of the present invention a (light transmissive) advertisement, which when lit from the inside of the illuminatable sign advertising element or its installation carrier is light transmissive (irrespective of whether, when the light source is turned off as is the case usually during natural daylight, it can be recognized or not from the outside), thus a so-to-speak light-transparent advertisement, which comprises, for example, a light transmissive lettering or other motif and -as explained- can be formed by printing, painting, cementing with plastic film, colored integral stamping or engraving in the front panel or in some other manner, where the presence of such an advertisement does not, of course, rule out that still other advertisements in the form of writing and/or picture components, which may or may not be light transmissive and, moreover, supplement in general the light transmissive advertisement, be it with an advertising message or with the formation of eye-catching illuminated [light technology] advertising elements, can be present on the front panel of the illuminatable sign advertising element.

Since the invention of the high voltage vapor discharge lamps called generally in short "neon tubes" in operating practice, on the one hand, and development and introduction of illuminatable sign advertising technology, on the other hand, these electric elements (called in short "neon tubes" hereinafter for the sake of simplicity) have played, as well-known, continuously a significant role in the illuminatable sign advertising technology, since they form especially prominent illuminatable sign elements both in white and in particular also in colored designs and correspondingly appeared to be always especially expedient and thus were popular, in particular to provide eye-catching illuminatable sign advertising elements due to the related advertising effectiveness.

Although the use of neon tubes in the illuminatable sign advertising technology temporarily decreased, presumably due to their relatively prominent physical appearance, the importance of these illuminatable sign advertising elements has risen significantly in the interim long since with respect to the technology of illuminatable sign advertising, probably, among other things, because the nostalgic effect associated with them has been rightly recognized by the advertising sector, so that they now form long since in turn a solid component of the illuminatable sign advertising technology.

However, the use of such neon tubes is unfortunately tied to a number of significant drawbacks, which lead to the fact that in the final analysis the idea of illuminatable sign advertising based on them or including their use is often not practiced at all.

First of all, a major drawback with neon lights lies in the fact that they still are rather expensive, so that corresponding illuminatable sign advertising plans often have to be abandoned merely on account of cost.

In addition, the routine care that is required for neon tubes is quite maintenance intensive, since they get dirty relatively fast due to the environment, thus it is necessary to clean them relatively frequently, in order to prevent negative advertising effects, which are caused by unignorable dirty illuminatable sign advertising and about which the professional world already know.

The neon tubes, which are installed as illuminatable sign advertising elements, are often broken or otherwise damaged during cleaning, since such cleaning work is routinely done by non-qualified, careless personnel.

In addition, neon tubes are subject in principle to the risk of igniting owing to the electric operations; and often said neon tubes are destroyed due to spontaneous combustion, resulting not only in a physical appearance that is temporarily unacceptable for advertising but also obviously in other (possibly significant) damages.

In consideration of the aforementioned and other drawbacks with the neon tubes intended for illuminatable sign advertising (as defined above), on the one hand, and the circumstance that the physical appearance of such neon tubes is suitable now as before—increasingly from the point of view of nostalgia—in particular for purposes or effects as regards illuminatable sign advertising, on the other hand, the present invention is based on the problem of providing an illuminatable sign advertising element of the class described above that gives the illuminated physical appearance with respect to its advertising -- as defined above --, but in fact yields for neon tubes so-to-speak an "engineering substitute solution", which can be maintained mot only better and at a significantly lower cost, contains no risk of fire, etc., and still gives the (electric advertising sign) effect of neon tubes, irrespective of whether the advertising of the illuminatable sign advertising element in question forms eye-catching elements or, for example, a flourish or another publicity motif, as can be produced in the conventional manner with neon tubes.

The problem is solved according to the invention in that the inside of the front panel is light transmissive in the region of the advertisement and is light impermeable in the adjacent regions, whereby the light intensity of the light transmissive region of the front panel underside varies widely, and in particular in general preferably the light transmission intensity in the central section of the light transmissive region is larger than it is the outer edge sections of the light transmissive region, as will be explained in detail at another point—in particular with respect to the embodiments.

To optimize the effect targeted according to the problem it is expedient if the light transmissive region assigned to an advertisement affixed to the outside of the front panel of the illuminatable sign advertising element essentially follows geometrically the advertisement concerned and is arranged preferably in essence symmetrically to the line(s) of symmetry of the advertisement.

Even though a highly preferred embodiment of the present invention (owing to cost alone) consists of the fact that the light transmissive region assigned to the respective advertisement is substantially slotted on the backside of the front panel, where the slot width of each section of the light transmissive region is narrower than the (outer) contour of the section of the advertisement in question; such a design of the solution to the above problem is not obligatory; just as it is not obligatory that slotted light transmissive regions must be designed necessarily so-to-speak without a filter, even though it is highly expedient and is accordingly to be preferred usually when the light transmissive region assigned to an advertisement is transmissive to bright—preferably white—light in its central region.

The region adjacent to the central region of a light transmissive region is preferably light transmissive for colored light, and especially in a preferred embodiment of the present invention for colored light, whose color is identical (or similar) to the color of the advertisement in question, since it has been demonstrated that in such a design the especially targeted "effect of neon tubes" is quite impressive.

One possible embodiment to obtain the targeted effect consists of the fact that the tinting intensity of a colored light transmissive region increases outwardly from the middle, where it is highly expedient if in the case of such a design the light transmission decreases continuously from the center towards the outside, and in particular preferably with such an intensity in the final analysis that the light transmission of a colored light transmissive region approaches approximately zero on its outer region adjacent to the adjoining light impermeable region, in order to produce in this manner diffuse zones in the transition region between light transmissive and light impermeable sections of the front panel (backside); said zones in interaction with the highly light transmissive central region of the respective light transmissive region causing the desired three dimensional plasticity effect.

Preferred embodiments of the invention are described in the dependent claims.

The invention is explained in detail in the following with embodiment with reference to the drawings.

Figure 6:
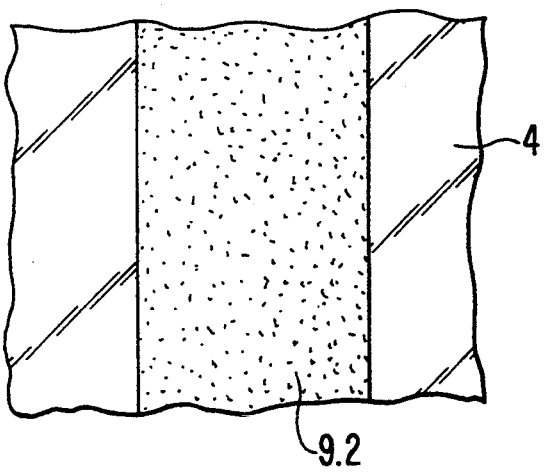
FIG. 6 shows section VI, which is framed by a dashed-dotted line, during daylight conditions (without turned on light source(s)).
Figure 6A:
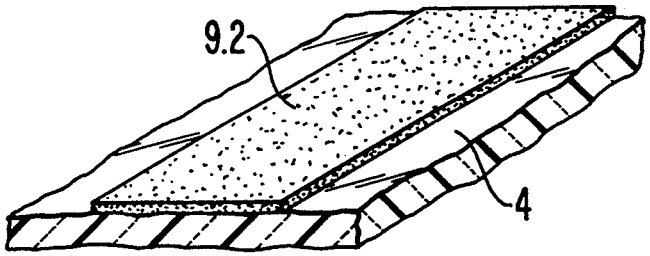

FIG. 6*a* is a perspective view, as seen by an observer, of the section according to FIG. 6.

Figure 1:
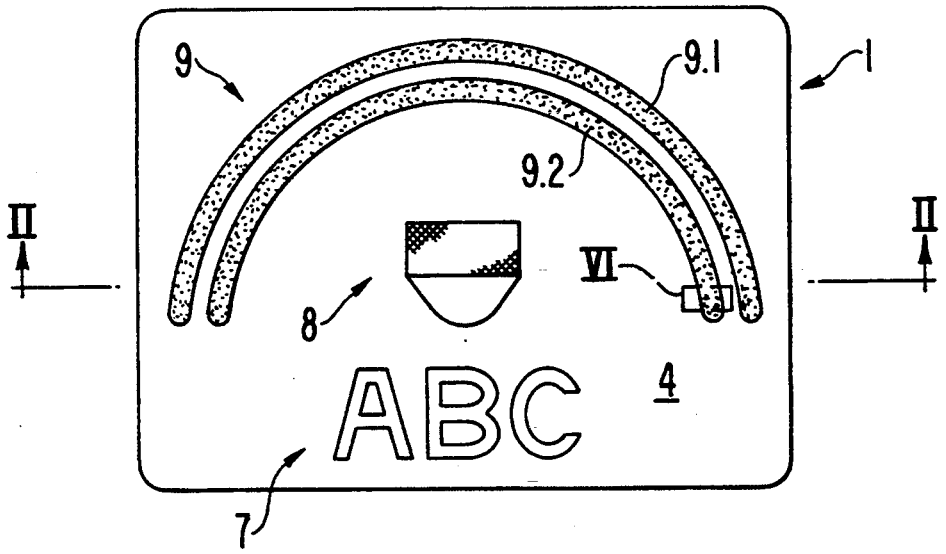
FIG. 1 is a somewhat simplified schematic top view of the visible side of an illuminatable sign advertising element according to the invention, seen in the direction of arrow I in FIG. 2.
Figure 7:
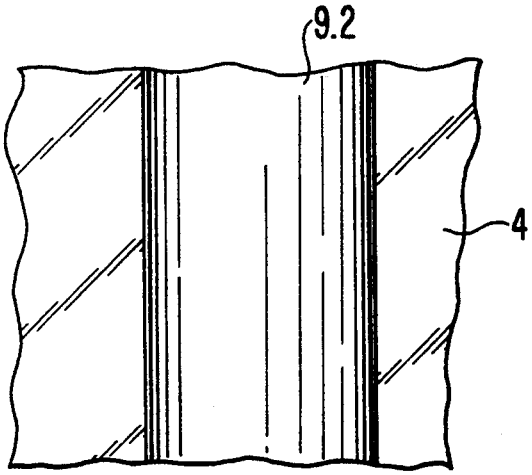

FIG. 7 shows section VI, framed in FIG. 1 with a dashed-dotted line, in darkness and with the light source turned on.

Figure 7A:
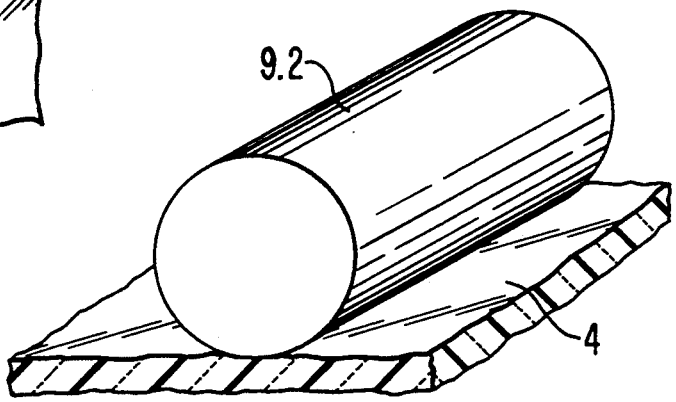

FIG. 7*a* shows the section reproduced in FIGS. 6, 6*a*, and 7, as it appears visually to an observer—despite its two dimensional design.

Figure 2:
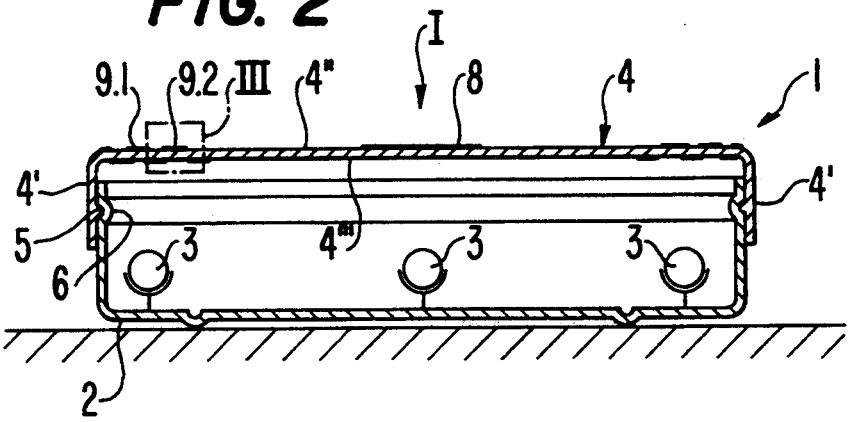
FIG. 2 is a schematic view of the illuminatable sign advertising element according to FIG. 1, seen in the direction of the cutline II—II.

FIG. 1 is top view of the visible side of an illuminatable advertising sign element, the whole of which is denoted as 1 (as seen in the direction of arrow I in FIG. 2) with a light impermeable installation carrier 2 (plate steel), which can be recognized from the sectional view according to FIG. 2 and whose inside is provided with several light sources 3 designed as normal luminescent tubes, and which is covered with an translucent, thus light permeable, but not transparent, white front panel 4 made of plastic which fits shape-lockingly and sealingly with side legs 4' and shoulders 5 extending around its inside into a peripheral groove 6 of the installation carrier 2.

The outside of the front panel is provided with several advertising elements or advertising units, in particular with a written character 7, an illustration 8 and two semicircular arcs 9.1 or 9.2 forming individually and jointly an optical eye-catcher.

The advertising elements 7 and 8 are of a conventional nature both in design and also in appearance, namely printed in silk screen printing on the outside 4'' of the front panel 4, while, the semicircular advertising elements 9.1 and 9.2, which together are also called "advertisement" 9 in the following, are an advertisement according to the invention that is to provide observers with the impression that the illuminatable sign advertising element 1 includes (according to the above definition) neon tubes, which are arranged obviously on the outside of the front panel 4 and they produce, in fact, this impression in the illuminated state even though the advertisement 9 does not exhibit any high voltage vapor discharge lamps at all and comprises the simplest and correspondingly most economical elements, as shall be explained in detail in the following.

The semicircular arcs 9.1 and 9.2 are colored, where both arcs 9.1, 9.2 and the written character 7 and picture 8 are printed on in silk screen printing (with a light transmissive color) on the front side 4'' of the front panel 4''' and give a two dimensional effect in the non-illuminated state (thus with light sources 3 not turned on) during day time or with natural light, during which an illuminatable sign advertising element provides merely a billboard effect.

Therefore, if light sources 3 are turned on especially at night, the advertising elements 9.1 and 9.2 appear to the observer from a relatively short distance to be (colored) three-dimensional neon tubes, whereas the written character 7 and the picture 8 have a two-dimensional effect now as before in accordance with their actual design.

This three-dimensional effect is achieved at a lower cost that is incomparable with respect to neon tubes in that the inside 4'' of the front panel 4 is designed light transmissive in the region of the advertisement 9.1, 9.2 and light impermeable in the regions 10 adjoining said light transmissive region, whereby the light transmission intensity varies as described later on. The light transmissive region 11 assigned to each advertisement 9.1 or 9.2, follows geometrically the advertisement concerned (for the drawing according to FIG. 3 thus advertisement 9.2), which is assigned to the outside 4'' of the front panel 4 above the light transmissive region 11, where the light transmissive region 11 is symmetrical to the advertisement 9.2 concerned, a feature that is obviously not obligatory.

Each light transmissive region 11 is designed in such a manner that its central region is more light transmissive than its outer regions, and in particular to bright, preferably white light, whereas adjacent to the central region of each light transmissive region 11 a limited transmission to colored light is provided, and in particular colored light, whose color is identical to the advertisement concerned (thus here advertisement 9.2).

Figure 3:
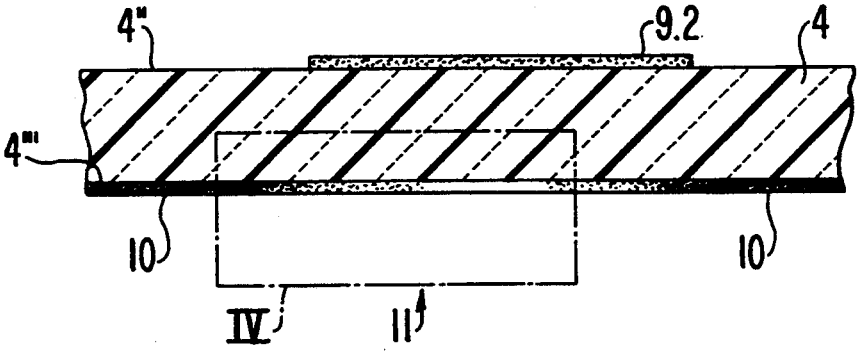
FIG. 3 is an enlarged view (approximately on a scale of 3:1 to the actual size) of the front panel section III, framed by a dashed-dotted line, according to FIG. 2.
Figure 4:
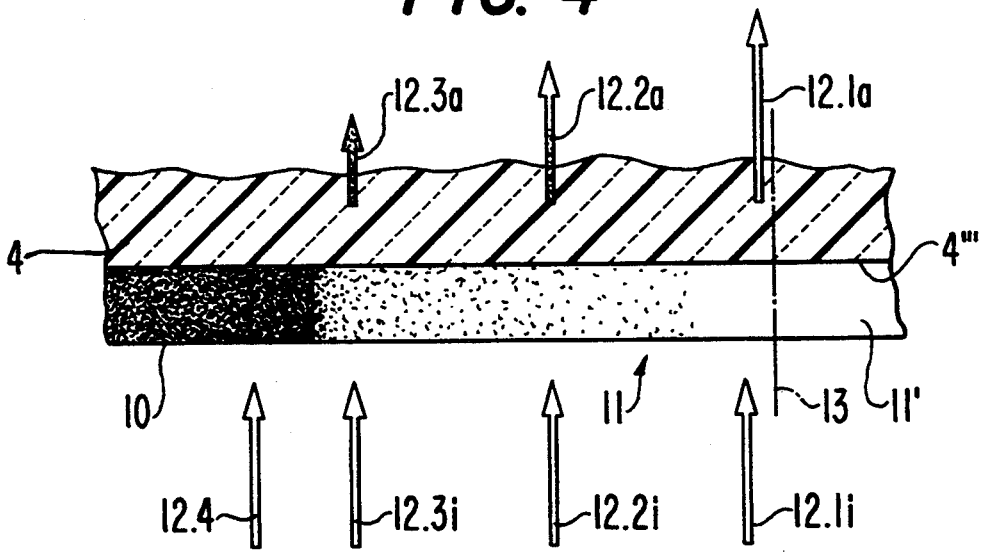
FIG. 4 shows section IV of FIG. 3, which is framed with a dashed-dotted line and which shows an enlarged view of a bottom or inner section of the front panel of the illuminatable sign advertising element as compared to that in FIG. 3.

As indicated from the view according to FIG. 3 or in section IV of FIG. 3 enlarged in FIG. 4, the light transmissive region 11 assigned to advertisement 9.2 can be designed in such a manner that its central region transmits white light produced by the light sources 3, as indicated by arrows 12.1i and 12.1a, whereas the diaphragm 11' forming the light transmissive region 11 is designed or tinted in such a manner that its pigmentation increases from the center of the advertisement 9.2, indicated by the dashed-dotted line 13, towards the outside, so that the light rays 12.2i and 12.3i, which are produced by the light sources 3 and whose intensity is in essence as great as the light rays 12.1i in the central section of the light transmissive region 11, are filtered increasingly as seen from the middle outwardly, so that the intensity of the light rays 12.2a or 12.3a issuing finally from the front panel 4 and entering into the advertisement 9.2 decreases from the center towards the outside of the light transmissive region 11; and finally only significantly weaker light issues from the outer regions of the advertisement 9.2 than from the central region, where it must be pointed out that the continuously increasing tinting of the diaphragm 11 is provided in the same coloration as the advertisement 9.2 assigned to it.

Figure 5:
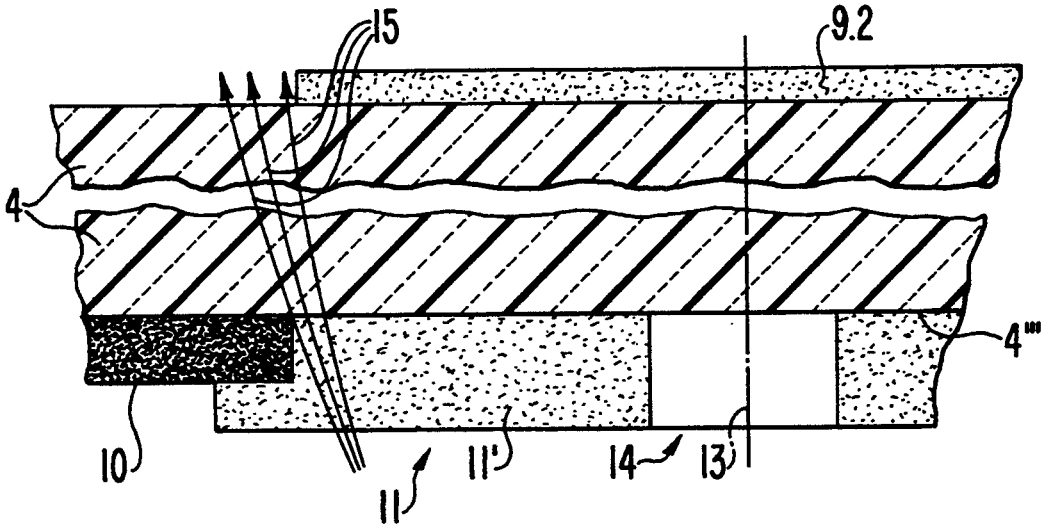
FIG. 5 is a view according to FIG. 4, which shows a modified design of that in FIGS. 3 and 4.

FIG. 5 shows an embodiment whose design is much simpler to construct, where in this modification the same or equally acting parts or sections are provided in turn with the same reference numerals as in FIGS. 1 to 4.

In the embodiment according to FIG. 5, region 10 adjoining the light transmissive region 11 is tinted in turn so as to be light impermeable (namely black), where in the projection region of advertisement 9.2 a recess is left on the inside 4''' of the front panel 4; said recess is provided so-to-speak with a "slit diaphragm" 11, where the central region 14 of this "slit diaphragm" 11 is left free and the remaining region—thus the region between the central region 14 and the adjoining light impermeable region 10—is uniformly tinted throughout, and in particular again with the same color as the assigned advertising element 9.2.

Thus, the result is virtually the same effects as, for example, with the embodiment according to FIGS. 3 and 4, where it must be added that the light rays 15, emitted by the light sources 3, which travel past the region of the light impermeable region 10 and impinge in particular in the outer region of the advertisement 9.2 or leave there in the direction of the outside, create a diffusion zone, which is involved substantially in the incredible effect of such an advertisement 9 according to the invention, as shall be illustrated with the aid of FIGS. 6, **6*a* and 7, 7*a*** in the following.

FIG. 6 is a partial top view of the front panel 4 of the illuminatable sign advertising element 1, and in particular a small cutout, which contains a part of the advertisement 9.2.

To explain once again how the advertisement 9.2 and thus also the partial segment shown in FIG. 6 are designed, the view according to FIG. 6 is shown once again as a perspective view in FIG. **6*a*, whereby the thickness of the (tinted) silk screen printing, which forms advertisement 9.2**, is highly exaggerated.

It is clear that such an advertisement 9 (in FIGS. 6 and **6*a* thus for example 9.2) is designed not only two dimensionally but also has the same effect in daylight without activating the light sources 3**.

If, in contrast, at night the light sources 3 are turned on, the advertisement 9.2 which is designed two dimensionally has close-up (and in particular at a somewhat greater distance) an incredible tubular, three dimensional effect (just like advertisement 9.1) as the drawing according to FIG. **7*a* is supposed to show; said advertisement reproduces the optical impression on an observer, so that, for example, the illuminatable sign advertising element shown in FIGS. 1 and 2 produces the impression as regards illuminated technology in an observer under conditions, under which said illuminatable sign advertising element is provided for the purpose of illuminatable sign advertising, as if the advertisements 9.1 and 9.2 were neon tubes, which are mounted on the outside 4'' of the front panel 4**.

No detailed references are necessary for the proper expert to the fact that this technology can be used obviously not only for geometric eye-catching elements, but also for written characters and other representations for which neon tubes can be normally used, where the possible applications go evidently well beyond those here.

I claim:

1. An illuminatable sign advertising element comprising:

a substantially light-impermeable installation carrier;

at least one light source disposed within an interior of said carrier;

a translucent front panel made from a translucent material covering said carrier, said front panel having an inside which is adjacent to the interior of said carrier and an outside; and at least one light transmissive advertisement disposed on the outside of said front panel, said advertisement having a color which is different from a color of a region of the front panel adjacent to the advertisement; wherein the inside of said front panel is light transmissive in an area substantially aligned with the advertisement and light-impermeable elsewhere, and a light transmissiveness of said light transmissive area varies gradually and regularly thereacross.

2. An illuminatable sign advertising element, as claimed in claim 1, wherein said light transmissive area essentially follows a shape of the advertisement.

3. An illuminatable sign advertising element, as claimed in claim 2, wherein said light transmissive area is substantially symmetrical about a line of symmetry of the advertisement.

4. An illuminatable sign advertising element, as claimed in claim 3, wherein said light transmissive area is substantially slotted.

5. An illuminatable sign advertising element, as claimed in claim 3, wherein said light transmissive area has a central region being more light transmissive than the remainder of the light transmissive area thereby transmitting brighter light than the remainder of said light transmissive area.

6. An illuminatable sign advertising element, comprising:

a substantially light-impermeable installation carrier;

at least one light source disposed within an interior of said carrier;

a translucent front panel made from a translucent material covering said carrier, said front panel having an inside adjacent to the interior of said carrier and an outside; and at least one light transmissive advertisement being disposed on said outside of said front panel, said advertisement having a color which is different from a color of a region of the front panel adjacent to the advertisement; wherein the inside of said front panel is light transmissive in an area substantially aligned with the advertisement and light-impermeable elsewhere, said light transmissive area essentially follows a shape of the advertisement and is substantially symmetrical about a line of symmetry of the advertisement, a light transmissiveness of said light transmissive area varies gradually and regularly thereacross, said light transmissive area has a central region being more light transmissive than the remainder of the light transmissive area thereby transmitting brighter light than the remainder of said light transmissive area, and said brighter light is white light.

7. An illuminatable sign advertising element, as claimed in claim 6, wherein said light transmissive area is colored so that colored light is transmitted adjacent to said central region of said light transmissive area.

8. An illuminatable sign advertising element, as claimed in claim 7, wherein said colored light has a color substantially similar to the color of the advertisement.

9. An illuminatable sign advertising element comprising:

a substantially light-impermeable installation carrier;

at least one light source disposed within an interior of said carrier;

a translucent front panel made from a translucent material covering said carrier, said front panel having an inside adjacent to the interior of said carrier and an outside; and at least one light transmissive advertisement being disposed on said outside of said front panel, said advertisement having a color which is different from a color of a region of the front panel adjacent to the advertisement; wherein the inside of said front panel is light transmissive in an area substantially aligned with the advertisement and light-impermeable elsewhere, said light transmissive area essentially follows a shape of the advertisement and is substantially symmetrical about a line of symmetry of the advertisement, said light transmissive area has a central region being more light transmissive than the remainder of the light transmissive area thereby transmitting brighter light than the remainder of said light transmissive area and a peripheral region adjacent to said central region which transmits colored light therethrough having a color substantially similar to the color of the advertisement, and a light transmissiveness of said light transmissive area decreases gradually from the central region outwardly.

10. An illuminatable sign advertising element, as claimed in claim 9, wherein the light transmissiveness of said light transmissive area decreases essentially continuously from the central region outwardly.

11. An illuminatable sign advertising element, as claimed in claim 9, wherein said light transmissiveness approaches zero at an outer region of said light transmissive area adjacent to the light impermeable area.

* * * * *